US009637803B2

(12) United States Patent
Hirano et al.

(10) Patent No.: US 9,637,803 B2
(45) Date of Patent: May 2, 2017

(54) ANNULAR WORKPIECE QUENCHING METHOD AND QUENCHING APPARATUS USED IN THE METHOD

(71) Applicant: JTEKT CORPORATION, Osaka-shi, Osaka (JP)

(72) Inventors: Tetsurou Hirano, Sakai (JP); Atsushi Kuno, Obu (JP)

(73) Assignee: JTEKT CORPORATION, Osaka-shi (JP)

( * ) Notice: Subject to any disclaimer, the term of this patent is extended or adjusted under 35 U.S.C. 154(b) by 649 days.

(21) Appl. No.: 13/956,627

(22) Filed: Aug. 1, 2013

(65) Prior Publication Data

US 2014/0041771 A1 Feb. 13, 2014

(30) Foreign Application Priority Data

Aug. 10, 2012 (JP) ..... 2012-177992
Sep. 7, 2012 (JP) ..... 2012-197368

(51) Int. Cl.
*C21D 1/18* (2006.01)
*C21D 1/673* (2006.01)
(Continued)

(52) U.S. Cl.
CPC ..... *C21D 1/18* (2013.01); *C21D 1/673* (2013.01); *C21D 9/34* (2013.01); *C21D 9/40* (2013.01)

(58) Field of Classification Search
CPC ..... C21D 1/673; C21D 9/34; C21D 9/40
(Continued)

(56) References Cited

U.S. PATENT DOCUMENTS 6,074,601 A 6/2000 Nakamura

FOREIGN PATENT DOCUMENTS

DE 2603618 A * 12/1976
DE 31 11 705 A1 10/1982
(Continued)

OTHER PUBLICATIONS

Jun. 7, 2016 Office Action issued in Japanese Patent Application No. 2012197368.
(Continued)

*Primary Examiner* — Jessee Roe
*Assistant Examiner* — Jenny Wu
(74) *Attorney, Agent, or Firm* — Oliff PLC

(57) ABSTRACT

An annular workplace quenching method includes: cooling an annular workpiece with an inner die arranged radially inward of the workpiece heated at a quenching temperature; pressing the workpiece in a width direction at a low pressure and inserting the workpiece in an outer die with restraint of an inner peripheral surface of the workpiece continued, when the restraint is started by contact with the inner die, after a temperature of the workpiece is decreased to 500° C. or lower but before the temperature is decreased to a martensitic transformation start temperature (Ms point); and restraining the workpiece in the width direction by pressing the workpiece in the width direction at a high pressure, and restraining an outer peripheral surface of the workpiece that undergoes volume expansion due to martensitic transformation, using the outer die, after the temperature of the workpiece is decreased to the Ms point or lower.

2 Claims, 4 Drawing Sheets

(51) Int. Cl.
*C21D 9/34* (2006.01)
*C21D 9/40* (2006.01)

(58) Field of Classification Search
USPC ..... 266/177; 148/647; 432/85
See application file for complete search history.

(56) References Cited

FOREIGN PATENT DOCUMENTS

| | | | | | |
|---|---|---|---|---|---|
| GB | 1496859 | A | * | 1/1978 | ..... C21D 1/673 |
| JP | 08003630 | A | * | 1/1996 | |
| JP | H08-3630 | A | | 1/1996 | |
| JP | 2005320609 | A | * | 11/2005 | |
| JP | A-2010-248556 | | | 11/2010 | |

OTHER PUBLICATIONS

Sep. 18, 2015 Extended Search Report in European Patent Application No. 13179719.3.

Hess K et al: "Mass-Und Formgenaues 1-3 Abschrecken Von Ringfoermigen Serienbauteilen in Vollautomatisierten Haertepressen", HTM Haerterei Technische Mitteilungen: Zeitschrift Fuer Werkstoffe, Waermebehandlung Und Fertigung, vol. 54, No. 6, 1999, pp. 378-384.

* cited by examiner

ANNULAR WORKPIECE QUENCHING METHOD AND QUENCHING APPARATUS USED IN THE METHOD

INCORPORATION BY REFERENCE

The disclosures of Japanese Patent Application No. 2012-177992 and No. 2012-197368 respectively filed on Aug. 10, 2012 and Sep. 7, 2012, each including the specification, drawings and abstract, are incorporated herein by reference in their entireties.

BACKGROUND OF THE INVENTION

1. Field of the Invention

The invention relates to an annular workpiece quenching method and a quenching apparatus used in the method.

2. Description of Related Art

High-carbon steel (hereinafter, referred to as "bearing steel") that exhibits temperature-dimension change characteristics as shown in FIG. 4 during heat treatment, is used for an annular member such as a bearing ring of a rolling bearing. The rolling bearing is manufactured by subjecting an annular workpiece made of the bearing steel to heat treatment such as quenching in order to obtain a desired mechanical strength. However, when the workpiece is subjected to quenching, the workpiece undergoes dimension change during the quenching, due to stress release and thermal expansion during heating and due to thermal contraction and transformation expansion caused by martensitic transformation during cooling. If the timing of the dimension change varies in the workpiece, distortion occurs, which may cause reduction in a roundness of the workpiece and dimensional variations.

In order to improve dimensional accuracy of inner and outer diameters of the heat-treated workpiece and reduce thermal distortion of the heat-treated workpiece, a heat treatment method described in Japanese Patent Application Publication No. 2010-248556 is proposed. In this heat treatment method, a workpiece is cooled in a state where an inner die is arranged radially inward of the workpiece that has been heated, and an inner peripheral surface of the workpiece undergoes thermal contraction to make contact with an outer peripheral surface of the inner die. In this way, the inner peripheral surface of the workpiece is restrained. Then, when a temperature of the workpiece becomes equal to or lower than a martensitic transformation start temperature in a cooling step, the workpiece is removed from the inner die, and then, the workpiece is inserted in an outer die such that an outer peripheral surface of the workpiece faces an inner peripheral surface of the outer die. In this state, the workpiece undergoes volume expansion due to the martensitic transformation, and the outer peripheral surface of the workpiece makes contact with the inner peripheral surface of the outer die. As a result, the outer peripheral surface of the workpiece is restrained.

In the above-described heat treatment method, when the temperature of the workpiece becomes equal to or lower than the martensitic transformation start temperature, the workpiece is removed from the inner die and is then inserted into the outer die to change a workpiece restraint state from a state where the inner peripheral surface of the workpiece is restrained to a state where the outer peripheral surface of the workpiece is restrained. However, if the timing of this change delays, in some cases, an outer diameter of the outer peripheral surface of the workpiece exceeds a predetermined outer diameter due to the volume expansion caused by the martensitic transformation, and, as a result, the workpiece is inserted into the outer die while the outer peripheral surface of the workpiece makes contact with the inner peripheral surface of the outer die. In this case, the outer peripheral surface of the workpiece is scratched due to contact with the outer die. As a result, an amount by which the workpiece is ground increases, which may prolong a cycle time in a grinding step.

SUMMARY OF THE INVENTION

The invention is made in light of the above-described circumstances, and one object of the invention is to provide an annular workpiece quenching method that makes it possible to prevent the annular workpiece from being damaged due to contact with an outer die, and a quenching apparatus used in the method.

An aspect of the invention relates to an annular workpiece quenching method, including the steps of: cooling an annular workpiece in a state where an inner die is arranged radially inward of the annular workpiece that has been heated at a quenching temperature; pressing the annular workpiece in a width direction at a low pressure and inserting the annular workpiece in an outer die with restraint of an inner peripheral surface of the annular workpiece continued, when the restraint of the inner peripheral surface of the annular workpiece is started by contact of the inner peripheral surface of the annular workpiece with the inner die due to contraction of the inner peripheral surface caused by cooling, after a temperature of the annular workpiece is decreased to a temperature equal to or lower than 500° C. but before the temperature of the annular workpiece is decreased to a martensitic transformation start temperature; and restraining the annular workpiece in the width direction between the inner die and a widthwise restraint jig by pressing the annular workpiece in the width direction at a high pressure, and restraining an outer peripheral surface of the annular workpiece by bringing the outer peripheral surface of the annular workpiece that undergoes volume expansion due to martensitic transformation, into contact with the outer die, after the temperature of the annular workpiece is decreased to a temperature that is equal to or lower than the martensitic transformation start temperature.

Another aspect of the invention relates to a quenching apparatus for quenching an annular workpiece. The quenching apparatus includes: a cooling jig that cools an annular workpiece that has been heated; an outer die that restrains an outer peripheral surface of the annular workpiece; an inner die that restrains an inner peripheral surface of the annular workpiece, and that is movable relative to the outer die so that the annular workpiece is inserted in the outer die by being pressed in a width direction by the inner die while the inner peripheral surface is restrained by the inner die; a widthwise restraint jig that restrains the annular workpiece moved into the outer die, by pressing the annular workpiece in the width direction between the widthwise restraint jig and the inner die; and a controller that controls movement of the inner die relative to the outer die to adjust a pressing force applied to the annular workpiece in the width direction.

BRIEF DESCRIPTION OF THE DRAWINGS

File foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, an embodiment of the invention will be described in detail with reference to the accompanying drawings.

Figure 1:
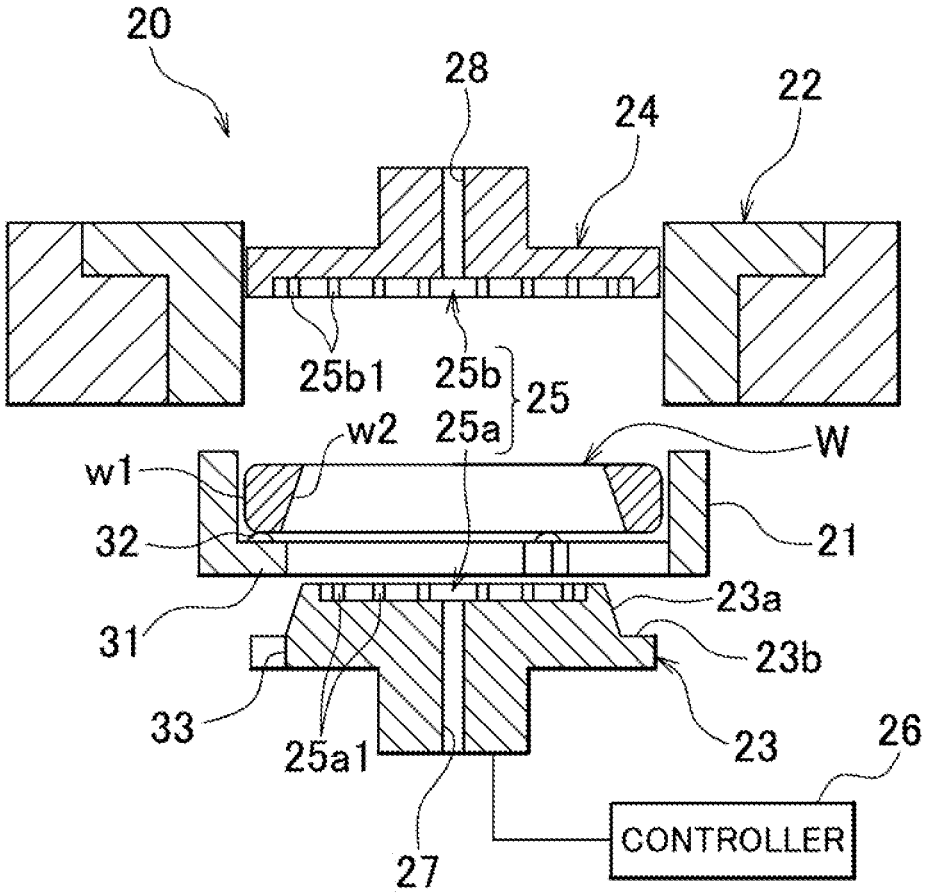
FIG. 1 is a sectional view schematically illustrating a configuration of main part of a quenching apparatus used in an annular workpiece quenching method according to an embodiment of the invention.

FIG. 1 is a sectional view schematically illustrating a configuration of main part of a quenching apparatus 20 used in an annular workpiece quenching method according to an embodiment of the invention. The quenching apparatus 20 includes a conveyor pallet 21 that conveys an annular workpiece (hereinafter, simply referred to as "workpiece") W, an outer die 22 that restrains an outer peripheral surface w1 of the workpiece W, an inner die 23 that restrains an inner peripheral surface w2 of the workpiece W, a width wise restraint jig 24 that restrains the workpiece W by pressing the workpiece W in the width direction at a position between the widthwise restraint jig 24 and the inner die 23, and a cooling jig 25 that cools the workpiece W that has been heated. The conveyor pallet 21 is arranged below the outer die 22, and is configured to convey the workpiece W between the inside and outside of the quenching apparatus 20 in a state where the workpiece W is placed at its axial one end face on the conveyor pallet 21. The widthwise restraint jig 24 is arranged at an upper position within the outer die 22, and is movable in the up-down direction with respect to the outer die 22.

The cooling jig 25 includes a disc-like first cooling portion 25*a* that is arranged so as to be substantially flush with an upper surface of the inner die 23, and a disc-like second cooling portion 25*b* that is arranged so as to be substantially flush with a lower surface of the widthwise restraint jig 24. The first and second cooling portions 25*a*, 25*b* are configured to spray cooling water supplied through supply passages 27, 28 that are formed in the inner die 23 and the widthwise restraint jig 24 along their axes, respectively, to cool the workpiece W. In order to uniformly cool the workpiece W, a plurality of grooves 25*a*1 and a plurality of grooves 25*b*1, through which the cooling water flow's, are formed in outer peripheral surfaces of the first and second cooling portions 25*a*. 25*b* at equal intervals in the circumferential direction, respectively.

The inner die 23 is arranged below the conveyor pallet 21, and is moved in the up-down direction with respect to the outer die 22 by a shift mechanism (not shown). The inner die 23 is formed in an annular shape. The inner die 23 has recesses 33 at three positions. The recesses 33 are recessed radially inward from an outer peripheral surface of the inner die 23, and are extended through the inner die 23 in the axial direction. The recesses 33 are formed so as to be arranged at equal intervals in the circumferential direction of the inner die 23. The conveyor pallet 21 is formed in an annular shape. The conveyor pallet 21 has protrusions 31 at three positions. The protrusions 31 extend radially inward from an inner peripheral surface of the conveyor pallet 21. The protrusions 31 are formed so as to be arranged at equal intervals in the circumferential direction of the conveyor pallet 21. Each of the protrusions 31 has a semispherical projection 32 that is projected upward in the vertical direction. The workpiece W is supported by top ends of the projections 32. Because positions of the recesses 33 and positions of the protrusions 31 coincide with each other in the circumferential direction, the inner die 23 is movable through the conveyor pallet 21 toward one side (vertically lower side) in die axial direction of the inner die 23 and toward the other side (vertically upper side) in the axial direction of the inner die 23. The inner die 23 is movable relative to the conveyor pallet 21. With this configuration, when the inner die 23 is elevated from the position shown in FIG. 1, the inner die 23 makes contact, at its flange portion, with one end face of the workpiece W, and an outer peripheral surface 23*a* of the inner die 23 is loosely fitted to the inner peripheral surface w2 of the workpiece W arranged on the conveyor pallet 21. In addition, the workpiece W is elevated together with the inner die 23 and is then inserted into the outer die 22. The workpiece W inserted in the outer die 22 is pressed in the width direction by a stepped surface 23*b* that is formed radially outward of the outer peripheral surface 23*a* of the inner die 23, and the lower surface of the widthwise restraint jig 24. As a result, the workpiece W is restrained. A movement of the inner die 23 in the up-down direction relative to the outer die 22 is controlled by a controller 26 that controls the shift mechanism. The controller 26 is able to adjust a pressing force applied to the workpiece W in the width direction by the inner die 23.

Figure 2:
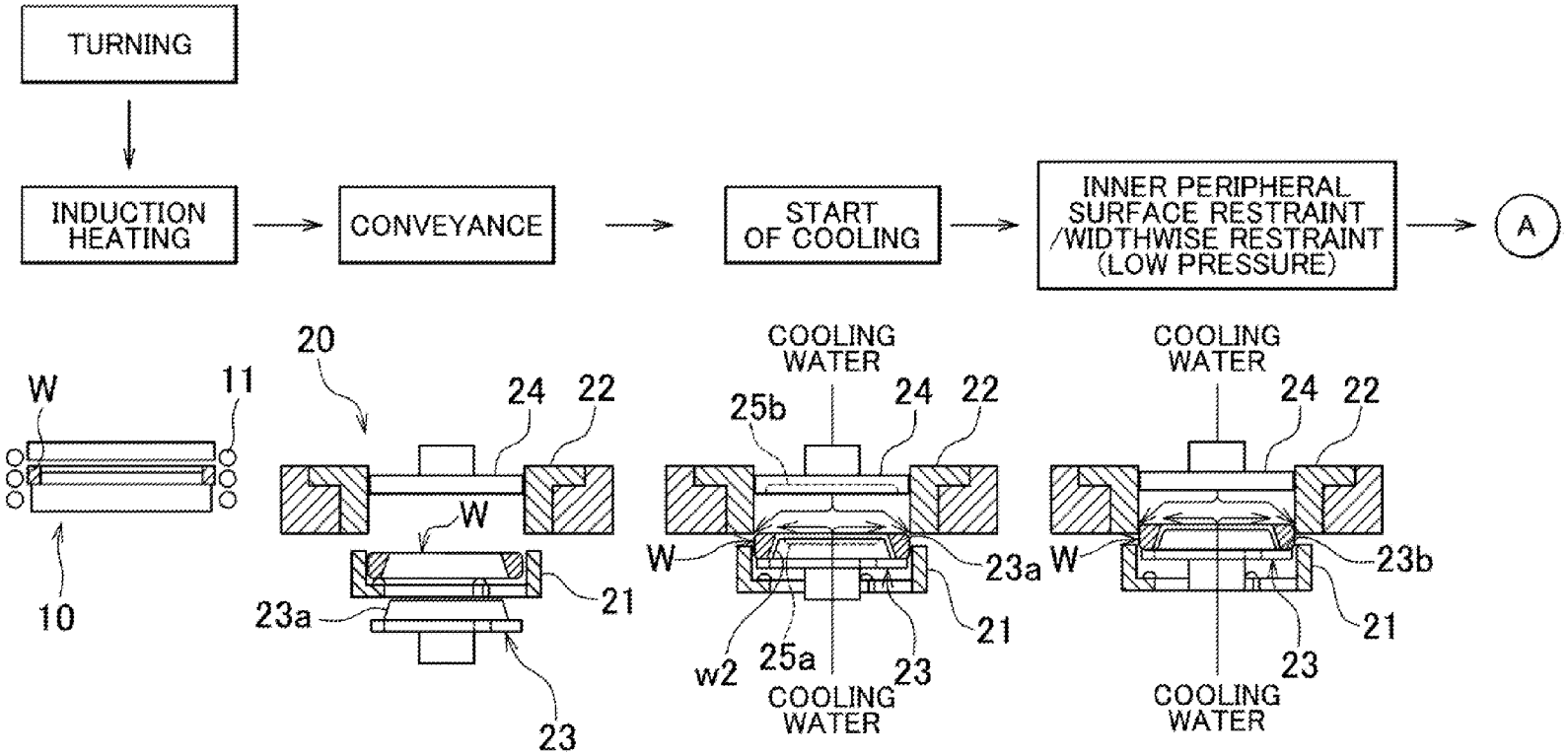
FIG. 2 is a process chart for explaining the annular workpiece quenching method according to the embodiment of the invention.
Figure 3:
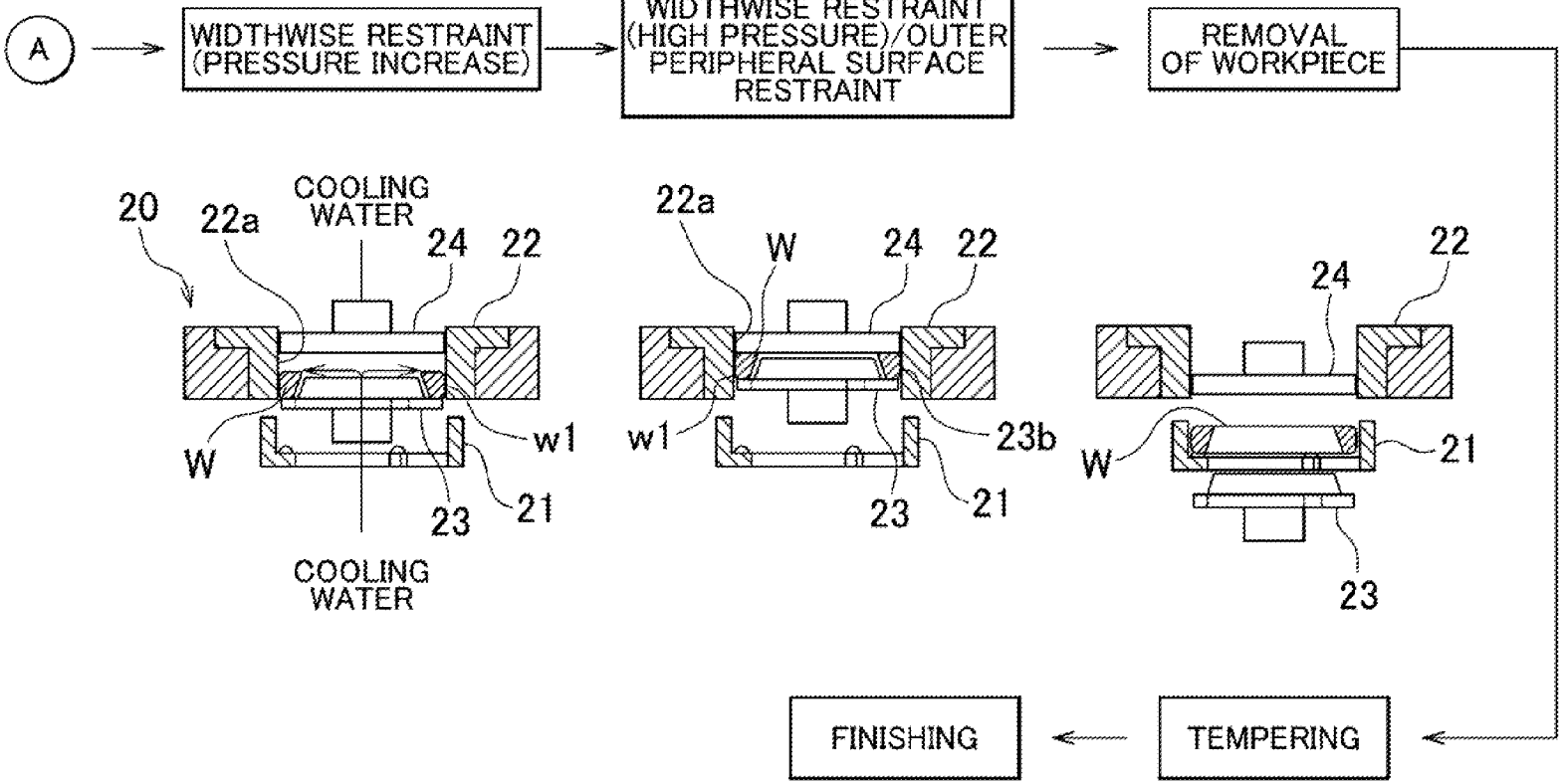
FIG. 3 is a process chart for explaining the annular workpiece quenching method according to the embodiment of the invention.

Next, description will be made regarding a workpiece quenching method according to the embodiment of the invention. A case where a bearing ring of a rolling bearing is manufactured with the use of the quenching apparatus 20 will be described as an example. FIG. 2 and FIG. 3 are process charts for explaining the workpiece quenching method according to the embodiment of the invention. Note that, in the present embodiment, a case where SUJ2 is used as bearing steel will be described.

First, an annular material piece is manufactured from steel material made of the bearing steel, and the thus manufactured annular material piece is formed into a predetermined shape through, for example, a cutting work. In this way, the workpiece W is obtained. "Turning" shown in FIG. 2 corresponds to this step.

Next, the workpiece W is arranged radially inward of a heating coil 11 of a high-frequency heating system 10, and is then induction-heated at a quenching temperature from 800 to 1,000° C. by supplying an alternating current to the heating coil 11. "Induction heating" shown in FIG. 2 corresponds to this step. Thus, the workpiece W is uniformly heated, and therefore the workpiece W is subjected to uniform stress release and austenitizing. Further, because the workpiece W itself is rapidly heated under the induction heating, the time that is required to heat the workpiece W is shortened to a level at which the heat treatment can be included in a consecutive production line. In this induction heating step, the volume of the workpiece W expands. This step corresponds to "expansion under heating" shown in FIG. 4.

After the induction-heating step, the workpiece W heated at the quenching temperature is conveyed by the conveyor pallet 21 to a position below the outer die 22 of the quenching apparatus 20. "Conveyance" shown in FIG. 2 corresponds to this step. The inner die 23 is elevated so as to be arranged radially inward of the workpiece W placed on the conveyor pallet 21. In this state, the cooling water is sprayed from the first and second cooling portions 25*a*, 25*b* of the cooling jig 25 to start cooling of the workpiece W. This step corresponds to "start of cooling" shown in FIG. 2. Further, this step corresponds to "start of cooling" shown in FIG. 4. During the cooling, by adjusting a flow rate of the cooling water sprayed from the cooling jig 25, a cooling rate of the workpiece W is adjusted. By cooling the workpiece W, the temperature of the workpiece W is decreased, and the volume of the workpiece W contracts due to a decrease in the temperature. This state corresponds to "contraction under cooling" shown in FIG. 4. Note that the cooling of the workpiece W by the cooling jig 25 is continued until a widthwise restraint (high pressure)/outer periphery restraint step, which will be described later.

The workpiece W thermally contracts freely without being restrained in the radial direction and the width direction until the temperature of the workpiece W is decreased to 500° C. When the temperature of the workpiece W is decreased to a temperature that is equal to or lower than 500° C., the inner diameter of the workpiece W becomes smaller than its turned dimension. Therefore, the inner peripheral surface w2 of the workpiece W makes contact with the outer peripheral surface 23*a* of the inner die 23. Thus, the inner peripheral surface w2 of the workpiece W starts to be restrained by the inner die 23. Thus, by making full use of stress caused by the thermal contraction of the workpiece W, it is possible to set the inner diameter of the workpiece W to a predetermined value, and to reduce distortion of the workpiece W.

After restraint of the inner periphery of the workpiece W is started, the inner die 23 is elevated together with the workpiece W to insert the workpiece W into the outer die 22 with the restraint of the inner periphery of the workpiece W continued, before the temperature of the workpiece W is decreased to a martensitic transformation start temperature (Ms point). At this time, the speed of elevation of the inner die 23 is controlled by the controller 26, and the workpiece W is inserted in the outer die 22 while the workpiece W is pressed in the width direction at a Sow pressure that does not hinder the thermal contraction of the workpiece W, for example, 0.5 to 2.0 MPa. Thus, both end surfaces of the workpiece W in the width direction start to be restrained between the stepped surface 23*b* of the inner die 23 and the lower surface of the widthwise restraint jig 24. This step corresponds to "inner peripheral surface restraint/widthwise restraint (low pressure)" shown in FIG. 2. Further, this step corresponds to "inner peripheral surface restraint/widthwise restraint (low pressure)" shown in FIG. 4.

After the entirety of the workpiece W is inserted in the outer die 22, the elevation speed of the inner die 23 is controlled to be accelerated by the controller 26 so that the pressure applied to the workpiece W in the width direction is increased. This step corresponds to "widthwise restraint (pressure increase)" shown in FIG. 3. Further, this step corresponds to "widthwise restraint (pressure increase)" shown in FIG. 4. In the present embodiment, the elevation speed of the inner die 23 is controlled such that the pressure applied to the workpiece W in the width direction is increased with a pressure change rate per unit time, which is within a range from 0.5 to 1.5 MPa/s.

After that, when the temperature of the workpiece W is decreased to a temperature that is equal to or lower than the martensitic transformation start temperature, the volume of the workpiece W expands due to the martensitic transformation in accordance with a decrease in the temperature. This state corresponds to "transformation expansion" shown in FIG. 4. At this time, the elevation speed of the inner die 23 is controlled by the controller 26 to press the workpiece W in the width direction at a high pressure, for example, 2 to 15 MPa. As a result, the both end surfaces of the workpiece W in the width direction are restrained at a high pressure between the stepped surface 23*b* of the inner die 23 and the lower surface of the widthwise restraint jig 24. Further, the outer peripheral surface w1 of the workpiece W is brought into contact with an inner peripheral surface 22*a* of the outer die 22, and thus restrained. This step corresponds to "widthwise restraint (high pressure)/outer peripheral surface restraint" shown in FIG. 3. Further, this step corresponds to "widthwise restraint (high pressure)/outer peripheral surface restraint" shown in FIG. 4. Thus, with the use of stress caused by the volume expansion under the martensitic transformation of the workpiece W, the outer diameter and the width of the workpiece W are set to predetermined dimensions, and, in addition, the distortion of the workpiece W is reduced.

When the outer peripheral surface restraint and the widthwise restraint of the workpiece W are completed, the widthwise restraint jig 24 and the inner die 23 are lowered, the workpiece W is placed on the conveyor pallet 21 again, and the workpiece W on the conveyor pallet 21 is conveyed to the outside of the quenching apparatus 20. This step corresponds to "removal of workpiece" shown in FIG. 3.

Next the workpiece W is subjected to tempering treatment in a tempering condition that allows the workpiece W to have a quality that corresponds to the required characteristics. This step corresponds to "tempering" shown in FIG. 3. In the tempering step, the workpiece W is heated to and maintained at a tempering temperature from 160 to 400° C. After that, the workpiece W is subjected to grind finishing and a raceway surface of the workpiece W is subjected to super finishing, so that the predetermined accuracy is obtained. In this way, it is possible to obtain a bearing ring which is a desired annular member. This step corresponds to "finishing" shown in FIG. 3.

In an experiment, a workpiece was quenched by the quenching apparatus in the quenching method according to the embodiment of the invention, and the outer peripheral surface of the workpiece was visually checked. Then, no scratch was found on the outer peripheral surface of the workpiece. Thus, it was confirmed that the embodiment of the invention is effective for prevention of damages to the workpiece.

According to the annular workpiece quenching method and the quenching apparatus used in the method in the embodiment of the invention, during cooling of the heated workpiece W, when the inner peripheral surface w2 of the workpiece W is brought into contact with the inner die 23 due to contraction caused by the cooling and the inner peripheral surface w2 of the workpiece W starts to be restrained after the temperature of the workpiece W is decreased to a temperature equal to or lower than 500° C. but before the temperature of the workpiece W is decreased to the martensitic transformation start temperature, the workpiece W is inserted into the outer die 22 with the restraint continued. Thus, it is possible to insert the workpiece W into the outer die 22 before the outer peripheral surface w1 of the workpiece W undergoes volume expansion due to the martensitic transformation. Further, during the insertion of the workpiece W into the outer die 22, the elevation speed of the inner die 23 is controlled by the controller 26, so that the workpiece W is pressed at a low pressure. Thus, it is possible to prevent the workpiece W from being forcibly inserted into the outer die 22. In this way, it is possible to prevent the outer peripheral surface w1 of the workpiece W from being scratched by the outer die 22 due to contact with the outer die 22. As a result, an amount by which the workpiece is ground is reduced, which makes it possible to shorten a cycle time in a grinding step.

Further, when the workpiece W is inserted into the outer die 22, the workpiece W is pressed in the width direction while the pressure applied to the workpiece W is gradually increased. Therefore, the thermal contraction of the workpiece W is less likely to be hindered in comparison with a case where the workpiece W is rapidly pressed at a high pressure.

In addition, by restraining the workpiece W at a temperature equal to or lower than 500° C. and at a low pressure, the workpiece W undergoes dimension change in a manner that substantially coincides with an inherent cooling curve during cooling of the workpiece W. Therefore, the workpiece W is restrained stably during the expansion of the workpiece W under the martensitic transformation after cooling. At this time, if the workpiece W is restrained at a high pressure, contraction of the workpiece W is hindered during cooling, which causes dimensional variations at the start time of the martensitic transformation. As a result, it is not possible to perform stable restraint and quenching.

Note that the invention is not limited to the above-described embodiment, and the invention may be implemented in various modified embodiments.

Figure 4:
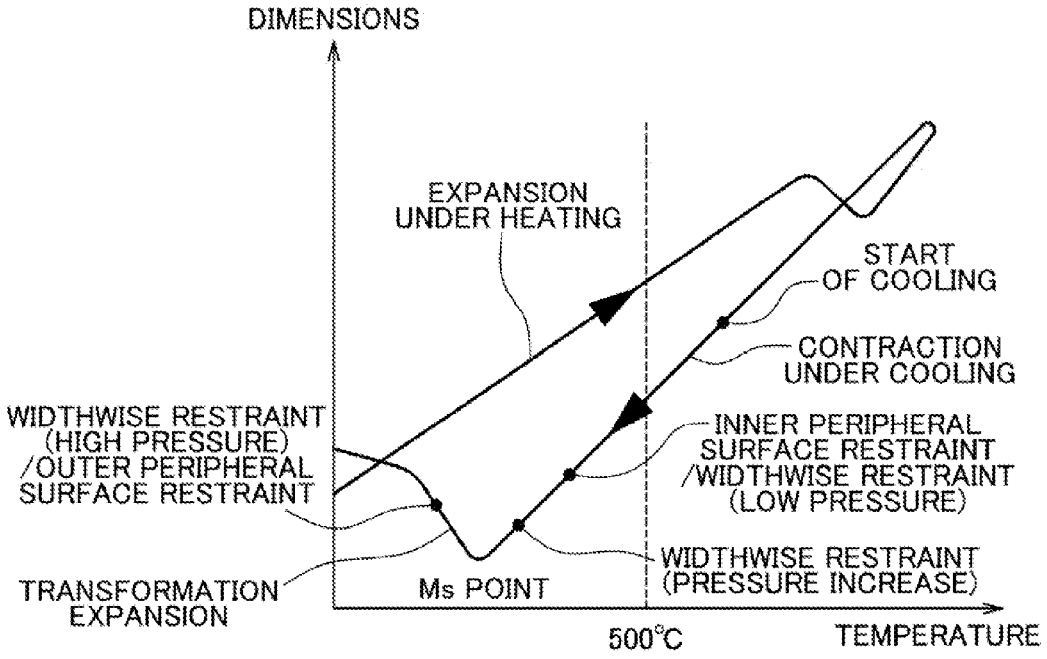
FIG. 4 is a graph showing a relationship between a temperature and dimensions in bearing steel during quenching.

For example, in the above-described embodiment, the induction heating is employed as the heating method in the heating step, and the workpiece W is heated by the induction heating. Alternatively, the workpiece W may be heated by furnace heating. Further, in the above-described embodiment, the workpiece W is cooled by the sprayed cooling water in the cooling step. Alternatively, the workpiece W may be cooled by placing the workpiece W in an oil bath. Moreover, in the above-described embodiment, SUJ2 is used as the bearing steel. However, another bearing steel that undergoes the dimension change as shown in FIG. 4 may be used in the invention. In this case, the quenching temperature, the tempering temperature and the like may be set as appropriate, depending on a kind of bearing steel to be used, use of the annular member, or the like.

What is claimed is:

1. An annular workpiece quenching method comprising the steps of:

cooling an annular workpiece in a state where an inner die is arranged radially inward of the annular workpiece that has been heated at a quenching temperature;

pressing the annular workpiece in a width direction at a first pressure ranging from 0.5 to 2.0 MPa and inserting the annular workpiece in an outer die with restraint of an inner peripheral surface of the annular workpiece continued, when the restraint of the inner peripheral surface of the annular workpiece is started by contact of the inner peripheral surface of the annular workpiece with the inner die due to contraction of the inner peripheral surface caused by cooling, after the temperature of the annular workpiece is decreased to a the temperature equal to or lower than 500° C. but before the temperature of the annular workpiece is decreased to a martensitic transformation start temperature; and restraining the annular workpiece in the width direction between the inner die and a widthwise restraint jig by pressing the annular workpiece in the width direction at a second pressure ranging from 2 to 15 MPa, and restraining an outer peripheral surface of the annular workpiece by bringing the outer peripheral surface of the annular workpiece that undergoes volume expansion due to martensitic transformation, into contact with the outer die, after the temperature of the annular workpiece is decreased to a temperature that is equal to or lower than the martensitic transformation start temperature, wherein, in the step of inserting the annular workpiece into the outer die, after an entirety of the annular workpiece is inserted into the outer die, the annular workpiece is pressed in the width direction while a pressure applied to the annular workpiece is gradually increased.

2. The annular workpiece quenching method according to claim 1, wherein, during the cooling step, the annular workpiece thermally contracts freely without restraint in the radial direction and the width direction until the temperature of the annular workpiece is decreased to a temperature equal to or lower than 500° C.

* * * * *